US009773580B2

(12) United States Patent
Yoshida et al.

(10) Patent No.: US 9,773,580 B2
(45) Date of Patent: Sep. 26, 2017

(54) ALUMINUM ALLOY WIRE ROD, ALUMINUM ALLOY STRANDED WIRE, COATED WIRE, WIRE HARNESS AND MANUFACTURING METHOD OF ALUMINUM ALLOY WIRE ROD

(71) Applicants: Furukawa Electric Co., Ltd., Tokyo (JP); Furukawa Automotive Systems Inc., Inukami-gun, Shiga (JP)

(72) Inventors: Sho Yoshida, Tokyo (JP); Shigeki Sekiya, Tokyo (JP); Kyota Susai, Tokyo (JP); Kengo Mitose, Tokyo (JP)

(73) Assignees: FURUKAWA ELECTRIC CO., LTD., Tokyo (JP); FURUKAWA AUTOMOTIVE SYSTEMS INC., Inukami-Gun, Shiga (JP)

( * ) Notice: Subject to any disclaimer, the term of this patent is extended or adjusted under 35 U.S.C. 154(b) by 0 days.

(21) Appl. No.: 14/695,934

(22) Filed: Apr. 24, 2015

(65) Prior Publication Data

US 2015/0235729 A1 Aug. 20, 2015

Related U.S. Application Data

(63) Continuation of application No. PCT/JP2013/080958, filed on Nov. 15, 2013.

(30) Foreign Application Priority Data

Mar. 29, 2013 (JP) ..... 2013-075402

(51) Int. Cl.

| | |
|---|---|
| ***C22C 21/08*** | (2006.01) |
| ***C22F 1/05*** | (2006.01) |
| ***H01B 1/02*** | (2006.01) |
| ***H01B 7/00*** | (2006.01) |
| ***C22F 1/04*** | (2006.01) |
| ***C22F 1/043*** | (2006.01) |
| ***C22F 1/047*** | (2006.01) |
| ***C22C 21/02*** | (2006.01) |
| ***C22C 21/00*** | (2006.01) |
| ***H01B 13/00*** | (2006.01) |

(52) U.S. Cl.

CPC ..... *H01B 1/023* (2013.01); *C22C 21/00* (2013.01); *C22C 21/02* (2013.01); *C22C 21/08* (2013.01); *C22F 1/04* (2013.01); *C22F 1/043* (2013.01); *C22F 1/047* (2013.01); *C22F 1/05* (2013.01); *H01B 7/0045* (2013.01); *H01B 13/00* (2013.01); *H01B 13/0016* (2013.01); *Y10T 428/2927* (2015.01)

(58) Field of Classification Search

CPC .... C22F 1/00; C22F 1/002; C22F 1/04; C22F 1/043; C22F 1/047; C22F 1/05; C22F 1/053; C22F 1/057; H01B 1/023

See application file for complete search history.

(56) References Cited

U.S. PATENT DOCUMENTS

| | | | | |
|---|---|---|---|---|
| 3,989,548 | A * | 11/1976 | Morris | C22C 1/026 148/437 |
| 7,544,892 | B2 * | 6/2009 | Susai | H01R 4/188 174/84 C |
| 2008/0230269 | A1 | 9/2008 | Susai et al. | |
| 2010/0059151 | A1 * | 3/2010 | Iwamura | C22C 21/12 148/690 |
| 2011/0140517 | A1 * | 6/2011 | Kusakari | B21C 1/00 307/9.1 |
| 2012/0321889 | A1 | 12/2012 | Sekiya et al. | |
| 2013/0126055 | A1 | 5/2013 | Sekiya et al. | |
| 2013/0264115 | A1 | 10/2013 | Kobayashi et al. | |

FOREIGN PATENT DOCUMENTS

| | | | |
|---|---|---|---|
| CN | 101317301 | A | 12/2008 |
| CN | 101558177 | A | 10/2009 |
| CN | 102119233 | A | 7/2011 |
| CN | 102803530 | A | 11/2012 |
| CN | 103298963 | A | 9/2013 |
| EP | 2 540 848 | A1 | 1/2013 |

(Continued)

OTHER PUBLICATIONS

"Glossary of Metallurgical and Metalworking Terms," Metals Handbook, ASM Handbooks Online, ASM International, 2002, pp. 1, 254, 157.*

International Preliminary Report on Patentability and English translation of the Written Opinion of the International Searching Authority (forms PCT/IB/373, PCT/ISA/237 and PCT/IB/326), issued Oct. 8, 2015, for International Application No. PCT/JP2013/080958.

Decision to Grant a Patent in Application No. 2014508614 on Aug. 11, 2014.

International Search Report, issued in PCT/JP2013/080958, dated Feb. 4, 2014.

Notification of Reasons for Refusal in Patent Application No. 2014-508614 on May 19, 2014.

(Continued)

*Primary Examiner* — Roy King
*Assistant Examiner* — Vanessa Luk
(74) *Attorney, Agent, or Firm* — Birch, Stewart, Kolasch & Birch, LLP

(57) ABSTRACT

An aluminum alloy wire rod has a composition consisting of Mg: 0.10 to 1.00 mass %, Si: 0.10 to 1.00 mass %, Fe: 0.01 to 1.40 mass %, Ti: 0.000 to 0.100 mass %, B: 0.000 to 0.030 mass %, Cu: 0.00 to 1.00 mass %, Ag: 0.00 to 0.50 mass %, Au: 0.00 to 0.50 mass %, Mn: 0.00 to 1.00 mass %, Cr: 0.00 to 1.00 mass %, Zr: 0.00 to 0.50 mass %, Hf: 0.00 to 0.50 mass %, V: 0.00 to 0.50 mass %, Sc: 0.00 to 0.50 mass %, Co: 0.00 to 0.50 mass %, Ni: 0.00 to 0.50 mass %, and the balance: Al and incidental impurities. A dispersion density of compound particles having a size of 20-1000 nm is 1 particle/$\mu m^2$ or higher. In a distribution of the compound particles in the aluminum alloy wire rod, a maximum dispersion density of the compound particles is less than or equal to five times a minimum dispersion density of the compound particles.

20 Claims, No Drawings

(56) References Cited

FOREIGN PATENT DOCUMENTS

| | | | |
|---|---|---|---|
| EP | 2 641 985 | A1 | 9/2013 |
| JP | 2010-163675 | A | 7/2010 |
| JP | 2012-229485 | A | 11/2012 |
| JP | 2013-44038 | A | 3/2013 |
| JP | 2013-44039 | A | 3/2013 |
| WO | WO 2012/011447 | A1 | 1/2012 |

OTHER PUBLICATIONS

Written Opinion of the International Searching Authority, issued in PCT/JP2013/080958, dated Feb. 4, 2014.

Extended European Search Report, dated Jul. 14, 2016, for counterpart European Application No. 13880629.4.

Chinese Office Action and Chinese Search Report, issued Sep. 21, 2016, for Chinese Application No. 201380053453.4, along with English translations.

Communication under Rule 71(3) EPC dated Jan. 19, 2017, for corresponding European Application No. 13880629.4.

Chinese Office Action and English translation thereof dated May 23, 2017, for corresponding Chinese Application No. 201380053453.4.

Korean Office Action for Application No. 10-2015-7031014, dated Jun. 14, 2017, with English language translation.

* cited by examiner

ALUMINUM ALLOY WIRE ROD, ALUMINUM ALLOY STRANDED WIRE, COATED WIRE, WIRE HARNESS AND MANUFACTURING METHOD OF ALUMINUM ALLOY WIRE ROD

CROSS REFERENCE TO RELATED APPLICATIONS

This is a continuation application of International Patent Application No. PCT/JP2013/080958 filed Nov. 15, 2013, which claims the benefit of Japanese Patent Application No. 2013-075402, filed Mar. 29, 2013, the full contents of all of which are hereby incorporated by reference in their entirety.

BACKGROUND

Technical Field

The present disclosure relates to an aluminum alloy conductor used as a conductor of an electric wiring structure, and particularly relates to an aluminum alloy conductor that provides high conductivity, high bending fatigue resistance, and also high elongation, even as an extra fine wire.

Background

In the related art, a so-called wire harness has been used as an electric wiring structure for transportation vehicles such as automobiles, trains, and aircrafts, or an electric wiring structure for industrial robots. The wire harness is a member including electric wires each having a conductor made of copper or copper alloy and fitted with terminals (connectors) made of copper or copper alloy (e.g., brass). With recent rapid advancements in performances and functions of automobiles, various electrical devices and control devices installed in vehicles tend to increase in number and electric wiring structures used for devices also tends to increase in number. On the other hand, for environmental friendliness, lightweighting is strongly desired for improving fuel efficiency of transportation vehicles such as automobiles.

As one of the measures for achieving recent lightweighting of transportation vehicles, there have been, for example, continuous efforts in the studies of changing a conductor of an electric wiring structure to aluminum or aluminum alloys, which is more lightweight than conventionally used copper or copper alloys. Since aluminum has a specific gravity of about one-third of a specific gravity of copper and has a conductivity of about two-thirds of a conductivity of copper (in a case where pure copper is a standard for 100% IACS, pure aluminum has approximately 66% IACS), a pure aluminum conductor wire rod needs to have a cross sectional area of approximately 1.5 times greater than that of a pure copper conductor wire rod to allow the same electric current as the electric current flowing through the pure copper conductor wire rod to flow through the pure aluminum conductor wire rod. Even an aluminum conductor wire rod having an increased cross sectional area as described above is used, using an aluminum conductor wire rod is advantageous from the viewpoint of lightweighting, since an aluminum conductor wire rod has a mass of about half the mass of a pure copper conductor wire rod. Note that, "% IACS" represents a conductivity when a resistivity $1.7241 \times 10^{-8}$ Ωm of International Annealed Copper Standard is taken as 100% IACS.

However, it is known that pure aluminum, typically an aluminum alloy conductor for transmission lines (JIS (Japanese Industrial Standard) A1060 and A1070), is generally poor in its durability to tension, resistance to impact, and bending characteristics. Therefore, for example, it cannot withstand a load abruptly applied by an operator or an industrial device while being installed to a car body, a tension at a crimp portion of a connecting portion between an electric wire and a terminal, and a cyclic stress loaded at a bending portion such as a door portion. On the other hand, an alloyed material containing various additive elements added thereto is capable of achieving an increased tensile strength, but a conductivity may decrease due to a solution phenomenon of the additive elements into aluminum, and because of excessive intermetallic compounds formed in aluminum, a wire break due to the intermetallic compounds may occur during wire drawing. Therefore, it is essential to limit or select additive elements to provide sufficient elongation characteristics to prevent a wire break, and it is further necessary to improve impact resistance and bending characteristics while ensuring a conductivity and a tensile strength equivalent to those in the related art.

Japanese Laid-Open Patent Publication No. 2012-229485 discloses a typical aluminum conductor used for an electric wiring structure of transportation vehicle. Disclosed therein is an extra fine wire that can provide an aluminum alloy conductor and an aluminum alloy stranded wire having a high strength and a high conductivity, as well as an improved elongation. Also, Japanese Laid-Open Patent Publication No. 2012-229485 discloses that sufficient elongation results in improved bending characteristics.

However, in the aluminum alloy conductor disclosed in Japanese Laid-Open Patent Publication No. 2012-229485, for example, when used as a wire harness attached to a door portion, fatigue fracture is likely to occur due to repeated bending stresses exerted by opening and closing of the door, and it cannot be said that bending fatigue resistance under such severe operating environment is sufficient. Further, assuming that it is attached to an engine portion, for example, a diesel engine which is said to produce a greatest vibration, a higher bending fatigue resistance which is capable of withstanding a constantly produced engine vibration is required.

The present disclosure is related to providing an aluminum alloy conductor, an aluminum alloy stranded wire, a coated wire, and a wire harness and to provide a method of manufacturing aluminum alloy conductor that can ensure a high conductivity and also achieve a high bending fatigue resistance, a high impact absorption and a high elongation, simultaneously.

The present inventors have found that with an uneven grain size in an aluminum alloy conductor, a portion in which the grain size is large has a lower strength and is likely to be deformed, an elongation of an aluminum alloy conductor as a whole decreases. Also, present inventors have found that in a case where the grain size is large, an accumulated amount of plastic strain is greater than a case in which the grain size is small, and a bending fatigue characteristics decreases. Thus, the present inventors have focused on the fact that a grain growth can be suppressed by introducing compound particles into an aluminum alloy. The present inventors carried out assiduous studies and found that by uniformly dispersing compound particles in an aluminum alloy conductor, crystal grains of an appropriate size are evenly formed, and thus a high bending fatigue resistance is obtained and an appropriate proof stress and a high elongation are further achieved, while ensuring a high conductivity, and contrived the present disclosure.

SUMMARY

According to a first aspect of the present disclosure, an aluminum alloy wire rod has a composition consisting of Mg: 0.10 mass % to 1.00 mass %, Si: 0.10 mass % to 1.00 mass %, Fe: 0.01 mass % to 1.40 mass %, Ti: 0.000 mass % to 0.100 mass %, 13: 0.000 mass % to 0.030 mass %, Cu: 0.00 mass % to 1.00 mass %, Ag: 0.00 mass % to 0.50 mass %, Au: 0.00 mass % to 0.50 mass %, Mn: 0.00 mass % to 1.00 mass %, Cr: 0.00 mass % to 1.00 mass %, Zr: 0.00 mass % to 0.50 mass %, Hf: 0.00 mass % to 0.50 mass %, V: 0.00 mass % to 0.50 mass %, Sc: 0.00 mass % to 0.50 mass %, Co: 0.00 mass % to 0.50 mass %, Ni: 0.00 mass % to 0.50 mass %, and the balance: Al and incidental impurities, wherein a dispersion density of compound particles having a particle size of 20 nm to 1000 nm is greater than or equal to 1 particle/$\mu m^2$ and in a distribution of the compound particles in the aluminum alloy wire rod, a maximum dispersion density of the compound particles is less than or equal to five times a minimum dispersion density of the compound particles.

According to a second aspect of the present disclosure, a wire harness comprises a coated wire including a coating layer at an outer periphery of one of an aluminum alloy wire rod and an aluminum alloy stranded wire; and a terminal fitted at an end portion of the coated wire, the coating layer being removed from the end portion, wherein the aluminum alloy wire rod has a composition consisting of Mg: 0.10 mass % to 1.00 mass %, Si: 0.10 mass % to 1.00 mass %, Fe: 0.01 mass % to 1.40 mass %, Ti: 0.000 mass % to 0.100 mass %, B: 0.000 mass % to 0.030 mass %, Cu: 0.00 mass % to 1.00 mass %, Ag: 0.00 mass % to 0.50 mass %, Au: 0.00 mass % to 0.50 mass %, Mn: 0.00 mass % to 1.00 mass %, Cr: 0.00 mass % to 1.00 mass %, Zr: 0.00 mass % to 0.50 mass %, Hf: 0.00 mass % to 0.50 mass %, V: 0.00 mass % to 0.50 mass %, Sc: 0.00 mass % to 0.50 mass %, Co: 0.00 mass % to 0.50 mass %, Ni: 0.00 mass % to 0.50 mass %, and the balance: Al and incidental impurities, wherein a dispersion density of compound particles having a particle size of 20 nm to 1000 nm is greater than or equal to 1 particle/$\mu m^2$ and in a distribution of the compound particles in the aluminum alloy wire rod, a maximum dispersion density of the compound particles is less than or equal to five times a minimum dispersion density of the compound particles.

According to a third aspect of the present disclosure, a method of manufacturing an aluminum alloy wire rod according to the first aspect of the disclosure, the aluminum alloy wire rod being obtained by carrying out a dissolving process, a casting process, a hot or cold working process, a first wire drawing process, an intermediate heat treatment, a second wire drawing process, a solution heat treatment and an aging heat treatment in this order, wherein, a cooling rate of the casting process is 5° C./s to 20° C./s, the intermediate heat treatment is performed in a temperature range of 300° C. to 480° C., an energy area of an energy applied to an aluminum alloy wire rod in the temperature range is 180° C.·h to 2500° C.·h, a die used in the first wire drawing process has a die half angle of 1° to 10° and a reduction ratio per pass is greater than 10% and less than or equal to 40%, and a die used in the second wire drawing process has a die half angle of 1° to 10° and a reduction ratio per pass is greater than 10% and less than or equal to 40%.

The aluminum alloy conductor of the present disclosure has an improved conductivity and thus it is useful as a conducting wire for a motor, a battery cable, or a harness equipped on a transportation vehicle. Particularly, since it has a high bending fatigue resistance, it can be used at a bending portion requiring high bending fatigue resistance such as a door or a trunk. Further, since it has a high impact absorption property and an improved elongation, it can withstand an impact during or after installation of a wire harness, and thus occurrence of wire breaks and cracks can be reduced. Further, an aluminum alloy conductor, an aluminum alloy stranded wire, a coated wire and a wire harness having an improved bending fatigue resistance and impact absorption property can be provided.

DETAILED DESCRIPTION

Further features of the present disclosure will become apparent from the following detailed description of exemplary embodiments.

An aluminum alloy conductor of the present disclosure has a composition consisting of Mg: 0.10 mass % to 1.00 mass %, Si: 0.10 mass % to 1.00 mass %, Fe: 0.01 mass % to 1.40 mass %, Ti: 0.000 mass % to 0.100 mass %, B: 0.000 mass % to 0.030 mass %, Cu: 0.00 mass % to 1.00 mass %, Ag: 0.00 mass % to 0.50 mass %, Au: 0.00 mass % to 0.50 mass %, Mn: 0.00 mass % to 1.00 mass %, Cr: 0.00 mass % to 1.00 mass %, Zr: 0.00 mass % to 0.50 mass %, Hf: 0.00 mass % to 0.50 mass %, V: 0.00 mass % to 0.50 mass %, Sc: 0.00 mass % to 0.50 mass %, Co: 0.00 mass % to 0.50 mass %, Ni: 0.00 mass % to 0.50 mass %, and the balance: Al and incidental impurities, wherein a dispersion density of compound particles having a particle size of 20 nm to 1000 nm is greater than or equal to 1 particle/$\mu m^2$.

Hereinafter, reasons for limiting chemical compositions or the like of the aluminum alloy conductor of the present disclosure will be described.

(1) Chemical Composition

<Mg: 0.10 mass % to 1.00 mass %>

Mg (magnesium) is an element having a strengthening effect by forming a solid solution with an aluminum base material and a part thereof having an effect of improving a tensile strength, a bending fatigue resistance and a heat resistance by being combined with Si to form precipitates. However, in a case where Mg content is less than 0.1 mass %, the above effects are insufficient. In a case where Mg content exceeds 1.0 mass %, there is an increased possibility that an Mg-concentration part will be formed on a grain boundary, thus resulting in decreased tensile strength, elongation, and bending fatigue resistance, as well as a reduced conductivity due to an increased amount of Mg element forming the solid solution. Accordingly, the Mg content is 0.10 mass % to 1.00 mass %. The Mg content is, when a high strength is of importance, preferably 0.50 mass % to 1.00 mass %, and in case where a conductivity is of importance, preferably 0.10 mass % to 0.50 mass %. Based on the points described above, 0.30 mass % to 0.70 mass % is generally preferable.

<Si: 0.10 mass % to 1.00 mass %>

Si (silicon) is an element that has an effect of improving a tensile strength, a bending fatigue resistance and a heat resistance by being combined with Mg to form precipitates. However, in a case where Si content is less than 0.10 mass %, the above effects are insufficient. In a case where Si content exceeds 1.00 mass %, there is an increased possibility that an Si-concentration part will be formed on a grain boundary, thus resulting in decreased tensile strength, elongation, and bending fatigue resistance, as well as a reduced conductivity due to an increased amount of Si element forming the solid solution. Accordingly, the Si content is 0.10 mass % to 1.00 mass %. The Si content is, when a high strength is of importance, preferably 0.50 mass % to 1.00 mass %, and in case where a conductivity is of importance, preferably 0.10 mass % to 0.50 mass %. Based on the points described above, 0.30 mass % to 0.70 mass % is generally preferable.

<Fe: 0.01 mass % to 1.40 mass %>

Fe (iron) is an element that contributes to refinement of crystal grains mainly by forming an Al—Fe based intermetallic compound and provides improved tensile strength and bending fatigue resistance. Fe dissolves in Al only by 0.05 mass % at 655 ° C. and even less at room temperature. Accordingly, the remaining Fe that could not dissolve in Al will be crystallized or precipitated as an intermetallic compound such as Al—Fe, Al—Fe—Si, and Al—Fe—Si—Mg. This intermetallic compound contributes to refinement of crystal grains and provides improved tensile strength and bending fatigue resistance. Further, Fe has, also by Fe that has dissolved in Al, an effect of providing an improved tensile strength. In a case where Fe content is less than 0.01 mass %, those effects are insufficient. In a case where Fe content exceeds 1.40 mass %, a wire drawing workability worsens due to coarsening of crystallized materials or precipitates. As a result, a target bending fatigue resistance cannot be achieved and also a conductivity decreases. Therefore, Fe content is 0.01 mass % to 1.40 mass %, and preferably 0.15 mass % to 0.90 mass %, and more preferably 0.15 mass % to 0.45 mass %.

The aluminum alloy conductor of the present disclosure includes Mg, Si and Fe as essential components, and may further contain at least one selected from a group consisting of Ti and B, and at least one selected from a group consisting of Cu, Ag, Au, Mn, Cr, Zr, Hf, V, Sc and Ni, as necessary.

<Ti: 0.001 mass % to 0.100 mass %>

Ti is an element having an effect of refining the structure of an ingot during dissolution casting. In a case where an ingot has a coarse structure, the ingot may crack during casting or a wire break may occur during a wire rod processing step, which is industrially undesirable. In a case where Ti content is less than 0.001 mass %, the aforementioned effect cannot be achieved sufficiently, and in a case where Ti content exceeds 0.100 mass %, the conductivity tends to decrease. Accordingly, the Ti content is 0.001 mass % to 0.100 mass %, preferably 0.005 mass % to 0.050 mass %, and more preferably 0.005 mass % to 0.030 mass %.

<B: 0.001 mass % to 0.030 mass %>

Similarly to Ti, B is an element having an effect of refining the structure of an ingot during dissolution casting. In a case where an ingot has a coarse structure, the ingot may crack during casting or a wire break is likely to occur during a wire rod processing step, which is industrially undesirable. In a case where B content is less than 0.001 mass %, the aforementioned effect cannot be achieved sufficiently, and in a case where B content exceeds 0.030 mass %, the conductivity tends to decrease. Accordingly, the B content is 0.001 mass % to 0.030 mass %, preferably 0.001 mass % to 0.020 mass %, and more preferably 0.001 mass % to 0.010 mass %.

To contain at least one of <Cu: 0.01 mass % to 1.00 mass %>, <Ag: 0.01 mass % to 0.50 mass %>, <Au: 0.01 mass % to 0.50 mass %>, <Mn: 0.01 mass % to 1.00 mass %>, <Cr: 0.01 mass % to 1.00 mass %>, <Zr: 0.01 mass % to 0.50 mass %>, <Hf: 0.01 mass % to 0.50 mass %>, <V: 0.01 mass % to 0.50 mass %>, <Sc: 0.01 mass % to 0.50 mass %>, <Co: 0.01 mass % to 0.50 mass %>, and <Ni: 0.01 mass % to 0.50 mass %>.

Each of Cu, Ag, Au, Mn, Cr, Zr, Hf, V, Sc, Co and Ni is an element having an effect of refining crystal grains, and Cu, Ag and Au are elements further having an effect of increasing a grain boundary strength by being precipitated at a grain boundary. In a case where at least one of the elements described above is contained by 0.01 mass % or more, the aforementioned effects can be achieved and a tensile strength, an elongation, and a bending fatigue resistance can be further improved. On the other hand, in a case where any one of Cu, Ag, Au, Mn, Cr, Zr, Hf, V, Sc, Co and Ni has a content exceeding the upper limit thereof mentioned above, a conductivity tends to decrease. Therefore, ranges of contents of Cu, Ag, Au, Mn, Cr, Zr, Hf, V, Sc, Co and Ni are the ranges described above, respectively.

The more the contents of Ti, B, Cu, Ag, Au, Mn, Cr, Zr, Hf, V, Sc, Co and Ni, the lower the conductivity tends to be and the more the wire drawing workability tends to deteriorate. Therefore, it is preferable that a sum of the contents of the elements is less than or equal to 2.00 mass %. With the aluminum alloy conductor of the present disclosure, since Fe is an essential element, the sum of contents of Fe, Ti, B, Cu, Ag, Au, Mn, Cr, Zr, Hf, V, Sc, Co and Ni is 0.01 mass % to 2.00 mass %. It is further preferable that the sum of contents of these elements is 0.10 mass % to 2.00 mass %.

In order to improve the tensile strength, the elongation, and the bending fatigue resistance while maintaining a high conductivity, the sum of contents of Fe, Ti, B, Cu, Ag, Au, Mn, Cr, Zr, Hf, V, Sc, Co and Ni is particularly preferably 0.10 mass % to 0.80 mass %, and further preferably 0.20 mass % to 0.60 mass %. On the other hand, in order to further improve the tensile strength, the elongation, and the bending fatigue resistance, although the conductivity will slightly decrease, it is particularly preferably 0.80 mass % to 2.00 mass %, and further preferably 1.00 mass % to 2.00 mass %.

<Balance: Al and Incidental Impurities>

The balance, i.e., components other than those described above, includes Al (aluminum) and incidental impurities. Herein, incidental impurities means impurities contained by an amount which could be contained inevitably during the manufacturing process. Since incidental impurities could cause a decrease in conductivity depending on a content thereof, it is preferable to suppress the content of the incidental impurities to some extent considering the decrease in the conductivity. Components that may be incidental impurities include, for example, Ga, Zn, Bi, and Pb.

(2) Dispersion Density of Compound Particles of Particle Size 20 nm to 1000 nm is $1/\mu m^2$ or More According to the present disclosure, a dispersion density of compound particles having a particle size of 20 nm to 1000 nm is 1 particle/μm2 or more. In a range of an alloy component of the present disclosure, there is no particular upper limit to the dispersion density of the compound particles.

According to the present disclosure, the compound particles are dispersed in a metallographic structure of an aluminum alloy conductor generally uniformly. A "uniform dispersion" of compound particles in the present disclosure is defined as follows. Firstly, a cross section perpendicular to a wire drawing direction of an aluminum alloy conductor was observed using a TEM and a square is drawn such that a predetermined number of (forty) compound particles are contained within the square. Then, using a square having a dimension identical to the said square, the number of particles contained in each square is counted at a plurality of arbitrary locations. Then, a ratio of a greatest value and a least value of the counted compound particles is obtained, and in a case where this ratio is less than or equal to a predetermined ratio, it is determined that the compound particles are dispersed uniformly. In the present disclosure, in a case where the ratio of the greatest value and the least value of the counted compound particles, i.e., a value obtained by dividing a maximum dispersion density by a minimum dispersion density is less than or equal to 5, it is defined that the compound particles are dispersed uniformly. In a case where the ratio of the greatest value and the least value is greater than 5, there will be a variation in crystal grains of the aluminum alloy, and elongation and bending fatigue resistance will decrease. Therefore, the ratio of the greatest value and the least value of the compound particles calculated in accordance with the aforementioned method is to be less than or equal to 5, and preferably less than or equal to 3, and more preferably less than or equal to 2.

The compound particle of the present disclosure is, for example, a compound including a constituent element of the aluminum alloy conductor of the present disclosure such as an Al-Fe based compound, TiB, $Mg_2Si$, a Fe-Mn based compound, a Fe—Mn—Cr based compound, and has an effect of suppressing the movement of a grain boundary. The compound particle has a particle size of 20 nm to 1000 nm, preferably 20 nm to 800 nm, and more preferably 30 nm to 500 nm. When the particle size of the compound particle is less than 20 nm, which is too small, a sufficient pinning effect cannot be obtained, and when the particle size is greater than 1000 nm, a grain boundary and dislocation will move in the compound particle and a sufficient pinning effect cannot be obtained. The particle size of the compound particle is measured, for example, using a TEM.

(Manufacturing Method of the Aluminum Alloy Conductor of the Present disclosure)

The aluminum alloy conductor of the present disclosure can be manufactured through each process including [1] melting process, [2] casting process, [3] hot or cold working process, [4] first wire drawing process, [5] intermediate heat treatment, [6] second wire drawing process, [7] solution heat treatment, and [8] aging heat treatment. Note that a bundling step or a wire resin-coating step may be provided before or after the solution heat treatment or after the aging heat treatment. Hereinafter, steps of [1] to [8] will be described.

[1] Melting Process

Melting is performed with such quantities that provide concentrations in respective embodiments of aluminum alloy compositions described below.

[2] Casting Process and [3] Hot or Cold Working Process

Using a Properzi-type continuous casting rolling mill which is an assembly of a casting wheel and a belt, molten metal is cast with a water-cooled mold and rolled into a bar of an appropriate size of, for example, ϕ5.0 mm to ϕ13.0 mm. A cooling rate during casting at this time is, in regard to preventing coarsening of Fe-based crystallized products and preventing a decrease in conductivity due to forced solid solution of Fe, preferably 5° C./s to 20° C./s. Casting and hot rolling may be performed by billet casting and an extrusion technique. Also, when the cooling rate during the casting is 5° C./s to 20° C./s, a particle size of the compound particle produced in a metal structure by a subsequent process will be smaller and a sufficient pinning effect can be obtained. Therefore, the cooling rate during the casting is 5° C./s to 20° C./s, preferably 10° C./s to 20° C./s, and more preferably, 15° C./s to 20° C./s.

[4] First Wire Drawing Process

Subsequently, the surface is stripped and the bar is made into an appropriate size of, for example, ϕ5.0 mm to ϕ12.5 mm, and wire drawing is performed by die drawing. It is preferable that a die has a die half angle α of 1° to 10°, and a reduction ratio per pass is greater than 10% and less than or equal to 40%. In a case where the die half angle is less than 1°, the length of a bearing portion at a die hole becomes greater, and a frictional resistance increases. In a case where the die half angle is greater than 10°, a strain is likely to be produced at an outer layer of a wire rod, which causes a variation in distribution of production of the compound particles in a subsequent heat treatment and also produces a variation in the grain size, and an elongation and a bending fatigue resistance will decrease. The reduction ratio is obtained by dividing a difference in cross sectional area before and after the wire drawing by the original cross sectional area and multiplying by 100. In a case where the reduction ratio is less than or equal to 10%, a strain is likely to be produced at an outer layer of a wire rod, which causes a variation in distribution of production of the compound particles in a subsequent heat treatment and also produces a variation in the grain size, and an elongation and a bending fatigue resistance will decrease. In a case where the reduction ratio is greater than 40%, the wire drawing becomes difficult and a wire break may arise during the wire drawing, which may cause a problem in quality such as a wire break during a wire drawing process. Also, by setting the die half angle in the aforementioned range and by setting the reduction ratio in the aforementioned range, respectively, dispersibility of the compound particles improves (particle distribution becomes uniform), and a variation in the grain size of the crystal grains of the aluminum parent phase can be suppressed. In this first wire drawing process, the stripping of the bar surface is performed first, but the stripping of the bar surface does not need to be performed.

[5] Intermediate Heat Treatment

Subsequently, an intermediate heat treatment (intermediate annealing) is applied on the cold-drawn work piece. The intermediate heat treatment of the present disclosure is carried out for retrieving the flexibility and increasing the wire drawing workability of the work piece, as well as, for producing compound particles. The heating temperature of an intermediate annealing is 300° C. to 480° C., and the heating time is normally from 0.05 hours to 6 hours. If the heating temperature is lower than 300° C., the compound particle does not grow and the suppression of the grain growth will be insufficient, and if it is higher than 480° C., although it depends on the heating time, coarsening of the particle size of the compound particle may occur. Also, if the heating time is six hours or more, there is an increased possibility of the coarsening of the particle size of the compound particle occurs, and it is also disadvantageous from the production point of view. An energy area during the intermediate annealing is 180° C.·h to 2500° C.·h. When the energy area is 180° C.·h to 2500° C.·h, the compound particle becomes smaller and a sufficient pinning effect can be obtained. According to the present disclosure, since a compound particle does not grow at or below 300° C., the energy area is heat (temperature that is higher than 300° C.) applied to a work piece integrated by time, in other words, an area of a part surrounded by a heat history (heat pattern) of the work piece and a straight line of t=300° C. The energy area in this intermediate annealing is preferably 500° C.·h to 2000° C.·h, and more preferably 500° C.·h to 1500° C.·h.

[6] Second Wire Drawing Process

Further, wire drawing of the work piece is performed by die drawing. It is preferable that the die has a die half angle of 1° to 10°, and a reduction ratio per pass is greater than 10% and less than or equal to 40%. Ina case where the die half angle is less than 1°, the length of a bearing portion at a die hole becomes greater, and a frictional resistance increases. In a case where the die half angle is greater than 10°, a strain is likely to be produced at an outer layer of a wire rod, which causes a variation in distribution of production of the compound particles in a subsequent heat treatment and also produces a variation in the grain size, and an elongation and a bending fatigue resistance will decrease. In a case where the reduction ratio is less than or equal to 10%, a strain is likely to be produced at an outer layer of a wire rod, which causes a variation in distribution of production of the compound particles in a subsequent heat treatment and also produces a variation in the grain size, and an elongation and a bending fatigue resistance will decrease. In a case where the reduction ratio is greater than 40%, the wire drawing becomes difficult and a wire break may occur during the wire drawing, which may cause a problem in quality. Also, by setting the die half angle to be small as in the aforementioned range and by setting the reduction ratio to be large as in the aforementioned range, a particle distribution of the compound particles becomes uniform, and a variation in the grain size of the crystal grains of the aluminum parent phase can be suppressed.

[7] Solution Heat Treatment

Subsequently, a solution heat treatment is applied to the work piece. This solution heat treatment is performed for dissolving an Mg compound and an Si compound randomly contained in the work piece into an aluminum parent phase. The heating temperature in the solution heat treatment is 480° C. to 620° C. and then cooled at an average cooling rate of greater than or equal to 11° C./s to a temperature of at least to 150° C. When a solution heat treatment temperature is lower than 480° C., solution treatment will be incomplete, and acicular $Mg_2Si$ precipitates that precipitate during an aging heat treatment in a post-processing decreases, and ranges of improvement of the tensile strength, the bending fatigue resistance, and the conductivity become smaller. When solution heat treatment is performed at a temperature higher than 620° C., the compound particles will be excessively dissolved as solid solution and the problem of coarsening of the crystal grain size of the aluminum parent phase may occur. Also, since more elements other than aluminum are contained as compared to pure aluminum, a fusing point lowers and may melt partially. The temperature in the solution heat treatment is preferably 500° C. to 600° C., and more preferably in a range of 520° C. to 580° C.

In a case where high-frequency heating and conduction heating are used, the wire rod temperature increases with a passage of time, since it normally has a structure in which electric current continues flowing through the wire rod. Accordingly, since the wire rod may melt when an electric current continues flowing through, it is necessary to perform heat treatment in an appropriate time range. In a case where running heating is used, since it is an annealing in a short time, the temperature of a running annealing furnace is usually set higher than a wire rod temperature. Since the wire rod may melt with a heat treatment over a long time, it is necessary to perform heat treatment in an appropriate time range. Also, all heat treatments require at least a predetermined time period in which an Mg compound and an Si compound contained randomly in the work piece will be dissolved into an aluminum parent phase. Hereinafter, the heat treatment by each method will be described.

The continuous heat treatment by high-frequency heating is a heat treatment by joule heat generated from the wire rod itself by an induced current by the wire rod continuously passing through a magnetic field caused by a high frequency. Steps of rapid heating and rapid cooling are included, and the wire rod can be heat-treated by controlling the wire rod temperature and the heat treatment time. The cooling is performed after rapid heating by continuously allowing the wire rod to pass through water or in a nitrogen gas atmosphere. This heat treatment time is 0.01 s to 2 s, preferably 0.05 s to 1 s, and more preferably 0.05 s to 0.5 s.

The continuous conducting heat treatment is a heat treatment by joule heat generated from the wire rod itself by allowing an electric current to flow in the wire rod that continuously passes two electrode wheels. Steps of rapid heating and rapid cooling are included, and the wire rod can be heat-treated by controlling the wire rod temperature and the heat treatment time. The cooling is performed after rapid heating by continuously allowing the wire rod to pass through water, atmosphere or a nitrogen gas atmosphere. This heat treatment time period is 0.01 s to 2 s, preferably 0.05 s to 1 s, and more preferably 0.05 s to 0.5 s.

A continuous running heat treatment is a heat treatment in which the wire rod continuously passes through a heat treatment furnace maintained at a high-temperature. Steps of rapid heating and rapid cooling are included, and the wire rod can be heat-treated by controlling the temperature in the heat treatment furnace and the heat treatment time. The cooling is performed after rapid heating by continuously allowing the wire rod to pass through water, atmosphere or a nitrogen gas atmosphere. This heat treatment time period is 0.5 s to 120 s, preferably 0.5 s to 60 s, and more preferably 0.5 s to 20 s.

The batch heat treatment is a method in which a wire rod is placed in an annealing furnace and heat-treated at a predetermined temperature setting and a setup time. The wire rod itself should be heated at a predetermined temperature for about several tens of seconds, but in industrial application, it is preferable to perform for more than 30 minutes to suppress uneven heat treatment on the wire rod. An upper limit of the heat treatment time is not particularly limited as long as there are five or more crystal grains when counted in a radial direction of the wire rod. However, since it is easier to obtain five or more crystal gains when counted in a radial direction of the wire rod when performed in a short time, in industrial application, since productivity is also good, heat treatment is performed within ten hours, and preferably within six hours.

[8] Aging Heat Treatment

Thereafter, an aging heat treatment is applied to a work piece. The aging heat treatment is conducted for precipitating acicular $Mg_2Si$ precipitates. The heating temperature in the aging heat treatment is 140° C. to 250° C., and the heating period is 1 minute to 15 hours. Since such thermal energy is important in the aging heat treatment, in order to precipitating acicular $Mg_2Si$ precipitates, a heat treatment within a short period of time, such as 1 minute, is preferable at high temperature side of, for example, 250° C. When the heating temperature is lower than 140° C., it is not possible to precipitate the acicular $Mg_2Si$ precipitates sufficiently, and strength, bending fatigue resistance and conductivity tends to lack. When the heating temperature is higher than 250° C., due to an increase in the size of the $Mg_2Si$ precipitate, the conductivity increases, but strength and bending fatigue resistance tends to lack.

(Aluminum Alloy Conductor According to the Present Disclosure)

An strand diameter of the aluminum alloy conductor of the present disclosure is not particularly limited and can be determined as appropriate depending on an application, and it is preferably ϕ0.1 mm to 0.5 mm for a fine wire, and ϕ0.8 mm to 1.5 mm for a case of a middle sized wire.

With the present aluminum alloy conductor, since compound particles of a particle size of 20 nm to 1000 nm are contained at a dispersion density of greater than or equal to 1 particle/$\mu m^2$ and the compound particles are uniformly dispersed in a metal structure, it is possible to achieve the number of cycles to fracture measured by a bending fatigue test of 100,000 times or more and an elongation of 5% to 20%. Also, the present aluminum alloy conductor can achieve a conductivity of 45% IACS to 60% IACS.

An impact absorption energy of the present disclosure is an index showing how much impact the aluminum alloy conductor can withstand, and calculated as (potential energy of the weight)/(cross sectional area of the aluminum alloy conductor) immediately before a wire break of the aluminum alloy conductor. It can be said that the higher the impact absorption energy, the higher the impact absorption property. With the present aluminum alloy conductor, an impact absorption energy of greater than or equal to 200 J/$cm^2$ can be achieved.

The aluminum alloy conductor according to the aforementioned embodiment was described above, but the present disclosure is not limited to the embodiment described above, and various alterations and modifications are possible based on a technical concept of the present disclosure.

For example, an aluminum alloy conductor of the present disclosure may be employed in an aluminum alloy stranded wire in which a plurality of aluminum alloy conductors are stranded together. Also, the aluminum alloy conductor or the aluminum alloy stranded wire is applicable to a coated wire having a coating layer at an outer periphery thereof. Also, it is applicable to a wire harness comprising a plurality of structures each including a coated wire and terminals attached to ends of the coated wire.

Also, a manufacturing method of an aluminum alloy conductor of the aforementioned embodiment is not limited to the embodiment described above, and various alterations and modifications are possible based on a technical concept of the present disclosure.

EXAMPLE

The present disclosure will be described in detail based on the following examples. Note that the present disclosure is not limited to examples described below.

Example I

Using a Properzi-type continuous casting rolling mill, molten metal containing Mg, Si, Fe and Al, and selectively added Mn, Ni, Ti and B with contents (mass %) shown in Table 1 is cast with a water-cooled mold and rolled into a bar of approximately 9.5 mm ϕ). A casting cooling rate at this time was approximately 15° C./s. Then, this was subject to a wire drawing at a 1 pass reduction ratio shown in Table 2. Then, an intermediate heat treatment (intermediate annealing) was performed under conditions shown in Table 2 on a work piece subjected to the wire drawing, and thereafter, a wire drawing was performed until a wire size of ϕ0.3 mm. Then, a solution heat treatment was applied to this work piece. In the solution heat treatment, in a case of a batch heat treatment, a wire rod temperature was measured with a thermocouple wound around the wire rod. In a case of continuous conducting heat treatment, since measurement at a part where the temperature of the wire rod is the highest is difficult due to the facility, the temperature was measured with a fiber optic radiation thermometer (manufactured by Japan Sensor Corporation) at a position upstream of a portion where the temperature of the wire rod becomes highest, and a maximum temperature was calculated in consideration of joule heat and heat dissipation. In a case of high-frequency heating and consecutive running heat treatment, a wire rod temperature in the vicinity of a heat treatment section outlet was measured. After the second heat treatment, an aging heat treatment was applied under conditions shown in Table 1 to produce an aluminum alloy wire.

Example II

Except that Mg, Si, Fe and Al and selectively added Cu, Mn, Hf, V, Sc, Co, Ni, Cr, Zr, Au, Ag, Ti and B were combined with contents (mass %) shown in Table 3, casting and rolling were carried out with a method similar to that of Example Ito form a rod of approximately 9.5 mm ϕ, and this was subjected to a wire drawing process at a 1 pass reduction ratio shown in Table 2. Then, an intermediate heat treatment was performed under conditions shown in Table 4 on a work piece subjected to the wire drawing, and thereafter, a wire drawing was performed until a wire size of ϕ0.3 mm. Then, a solution heat treatment was further applied on this work piece. After the solution treatment, an aging heat treatment was applied under conditions shown in Table 4 to produce an aluminum alloy wire.

For each of aluminum alloy wires of the Example and the Comparative Example, each characteristic was measured by methods shown below. The results are shown in Tables 2 and 4.

(a) Particle Distribution of Compound Particles

Using a photographic image captured by observing a cross section perpendicular to a wire drawing direction of an aluminum alloy conductor using a TEM at an arbitrary magnification of 500,000 to 600,000, a square was drawn such that a predetermined number of (forty) compound particles are contained within the square. Then, using a square having a dimension identical to the said square, the number of particles contained in each square was counted at a plurality of 30 arbitrary locations. Then, a ratio of a greatest value and a least value of the counted compound particles was obtained. In the present disclosure, the ratio of the greatest value and the least value of the counted compound particles, i.e., a value obtained by dividing a maximum dispersion density by a minimum dispersion density of less than or equal to 5 was regarded as acceptable.

(b) Particle Density of Compound Particles

Wire rods of Examples and Comparative Examples were formed as thin films by a FIB (Focused Ion Beam) method and an arbitrary range was observed using a transmission electron microscope (TEM). Those compound particles having a particle size of 20 nm to 1000 nm prescribed above were counted in the captured image. In a case where a particle extends outside the measuring range, it is counted if half or more of the particle size was include in the measuring range. The dispersion density of the compound particle was obtained by setting a range in which 40 particles can be counted and calculating using an equation: Dispersion Density of Compound Particle (number of particles/$\mu m^2$)=Number of Compound Particles (number of particles)/Count Target Range ($\mu m^2$). Depending on the situation, a plurality of photographic images were used as the count target range. In a case where there were few particles and it was not possible to count 40 or more, 1 $\mu m^2$ was specified and a dispersion density in that range was calculated. Note that the dispersion density of compound particles was calculated with a sample thickness of the thin film of 0.15 μm being taken as a reference thickness. In a case where the sample thickness is different from the reference thickness, the dispersion density can be calculated by converting the sample thickness with the reference thickness, in other words, multiplying (reference thickness/sample thickness) by a dispersion density calculated based on the captured image. In the present examples and the comparative examples, all the samples were produced using a FIB method by setting the sample thickness to approximately 0.15 μm. If the dispersion density of compound particles of a particle size of 20 nm to 1000 nm was greater than or equal to 1 particle/$\mu m^2$, it was regarded as "acceptable", and if not in such a state of dispersion, regarded as "not acceptable".

(c) Number of Cycles to Fracture

As a reference of the bending fatigue resistance, a strain amplitude at an ordinary temperature is assumed as ±0.17%. The bending fatigue resistance varies depending on the strain amplitude. In a case where the strain amplitude is large, a fatigue life decreases, and in a case where the strain amplitude is small, the fatigue life increases. Since the strain amplitude can be determined by a wire size of the wire rod and a radius of curvature of a bending jig, a bending fatigue test can be carried out with the wire size of the wire rod and the radius of curvature of the bending jig being set arbitrarily. With a reversed bending fatigue tester manufactured by Fujii Seiki Co., Ltd. (existing company Fujii Co., Ltd.) and using a jig that can give a 0.17% bending strain, a repeated bending was carried out and a number of cycles to fracture was measured. In the present examples, number of cycles to fracture of 100,000 times or more was regarded as acceptable.

(d) Measurement of Flexiblility (Elongation after Fracture)

In conformity with JIS Z2241, a tensile test was carried out for three materials under test (aluminum alloy wires) each time, and an average value thereof was obtained. As for the elongation, an elongation after fracture of greater than or equal to 5% was regarded as acceptable.

(e) Measurement of Impact Absorption Energy

A weight was attached to one end of the aluminum alloy conductor wire and the weight was allowed to fall freely from a height of 300 mm. The weight was changed into a heavier weight sequentially, and the absorbing energy was calculated from the weight immediately before a wire break. The impact absorption energy was calculated by (potential energy of weight)/(cross sectional area of aluminum alloy conductor) immediately before a wire break of the aluminum alloy conductor, and 200 J/$cm^2$ was regarded as acceptable.

(f) Conductivity (EC)

In a constant temperature bath in which a test piece of 300 mm in length is held at 20° C. (±0.5° C.), a resistivity was measured for three materials under test (aluminum alloy wires) each time using a four terminal method, and an average conductivity was calculated. The distance between the terminals was 200 mm. The conductivity of greater than or equal to 45% IACS was regarded as acceptable.

TABLE 1

| | | COMPOSITION MASS % | | | | | | | | | | | | | | | | |
|---|---|---|---|---|---|---|---|---|---|---|---|---|---|---|---|---|---|---|
| | No. | Mg | Si | Fe | Cu | Mn | Hf | V | Sc | Co | Ni | Cr | Zr | Au | Ag | Ti | B | Al |
| EXAMPLE | 1 | 0.50 | 0.50 | 0.20 | | 0.05 | | | | | 0.10 | | | | | 0.010 | 0.005 | |
| | 2 | 0.50 | 0.50 | 0.20 | | 0.05 | | | | | 0.10 | | | | | 0.010 | 0.005 | |
| | 3 | 0.50 | 0.50 | 0.20 | | 0.05 | | | | | 0.10 | | | | | 0.010 | 0.005 | |
| | 4 | 0.50 | 0.50 | 0.20 | | 0.05 | | | | | 0.10 | | | | | 0.010 | 0.005 | |
| | 5 | 0.50 | 0.50 | 0.20 | | 0.05 | | | | | 0.10 | | | | | 0.010 | 0.005 | |
| | 6 | 0.50 | 0.50 | 0.20 | | 0.05 | | | | | 0.10 | | | | | 0.010 | 0.005 | |
| | 7 | 0.50 | 0.50 | 0.20 | | 0.05 | | | | | 0.10 | | | | | 0.010 | 0.005 | |
| | 8 | 0.50 | 0.50 | 0.20 | | 0.05 | | | | | 0.10 | | | | | 0.010 | 0.005 | |
| | 9 | 0.50 | 0.50 | 0.20 | | 0.05 | | | | | 0.10 | | | | | 0.010 | 0.005 | |
| | 10 | 0.50 | 0.50 | 0.20 | | 0.05 | | | | | 0.10 | | | | | 0.010 | 0.005 | |
| | 11 | 0.50 | 0.50 | 0.20 | | 0.05 | | | | | 0.10 | | | | | 0.010 | 0.005 | |
| | 12 | 0.50 | 0.50 | 0.20 | | 0.05 | | | | | 0.10 | | | | | 0.010 | 0.005 | |
| | 13 | 0.50 | 0.50 | 0.20 | | 0.05 | | | | | 0.10 | | | | | 0.010 | 0.005 | |
| | 14 | 0.50 | 0.50 | 0.20 | | 0.05 | | | | | 0.10 | | | | | 0.010 | 0.005 | |
| COMPARATIVE EXAMPLE | 1 | 0.50 | 0.50 | 0.20 | | 0.05 | | | | | 0.10 | | | | | 0.010 | 0.005 | |
| | 2 | 0.50 | 0.50 | 0.20 | | 0.05 | | | | | 0.10 | | | | | 0.010 | 0.005 | |
| | 3 | 0.50 | 0.50 | 0.20 | | 0.05 | | | | | 0.10 | | | | | 0.010 | 0.005 | |
| | 4 | 0.50 | 0.50 | 0.20 | | 0.05 | | | | | 0.10 | | | | | 0.010 | 0.005 | |
| | 5 | 0.50 | 0.50 | 0.20 | | 0.05 | | | | | 0.10 | | | | | 0.010 | 0.005 | |
| | 6 | 0.50 | 0.50 | 0.20 | | 0.05 | | | | | 0.10 | | | | | 0.010 | 0.005 | |

TABLE 2

| | | | DRAWING PROCESS | | | | | |
|---|---|---|---|---|---|---|---|---|
| | | CASTING COOLING | REDUCTION RATIO PER | DIE HALF | INTERMEDIATE ANNEALING | AGING | | DISPERISON |
| | No. | RATE ° C./sec | PASS % | ANGLE DEGREE | ENERGY AREA ° C. · h | TEMP. ° C. | TIME h | DENSITY DETERMINATION |
| EXAMPLE | 1 | 5 | 16 | 3 | 180 | 200 | 1 | ACCEPTABLE |
| | 2 | 10 | 32 | 1 | 600 | 200 | 15 | ACCEPTABLE |
| | 3 | 5 | 36 | 2 | 2400 | 250 | 0.5 | ACCEPTABLE |
| | 4 | 20 | 37 | 1 | 1800 | 200 | 15 | ACCEPTABLE |
| | 5 | 20 | 38 | 2 | 2400 | 175 | 15 | ACCEPTABLE |
| | 6 | 5 | 39 | 4 | 1200 | 175 | 1 | ACCEPTABLE |
| | 7 | 10 | 28 | 7 | 1800 | 175 | 5 | ACCEPTABLE |

TABLE 2-continued

| | | | | | | | | |
|---|---|---|---|---|---|---|---|---|
| | 8 | 15 | 39 | 5 | 1200 | 175 | 15 | ACCEPTABLE |
| | 9 | 20 | 10 | 10 | 600 | 150 | 5 | ACCEPTABLE |
| | 10 | 20 | 15 | 4 | 180 | 140 | 15 | ACCEPTABLE |
| | 11 | 5 | 18 | 6 | 2400 | 140 | 10 | ACCEPTABLE |
| | 12 | 20 | 37 | 3 | 1200 | 150 | 5 | ACCEPTABLE |
| | 13 | 20 | 40 | 1 | 2400 | 140 | 5 | ACCEPTABLE |
| | 14 | 20 | 35 | 4 | 600 | 150 | 10 | ACCEPTABLE |
| COMPARA-TIVE EXAMPLE | 1 | 20 | 10 | 6 | 0 | 175 | 5 | ***NOT ACCEPTABLE*** |
| | 2 | 10 | 30 | ***20*** | WIRE BREAK DURING WIRE DRAWING | | | |
| | 3 | ***2*** | 10 | 6 | 1500 | 175 | 5 | ***NOT ACCEPTABLE*** |
| | 4 | 10 | 15 | 5 | ***3500*** | 150 | 5 | ***NOT ACCEPTABLE*** |
| | 5 | 15 | ***50*** | 10 | WIRE BREAK DURING WIRE DRAWING | | | |
| | 6 | 5 | ***5*** | ***11*** | 300 | 175 | 5 | ACCEPTABLE |

| | No. | GRAIN DISTRIBUTION MAX/MIN FACTOR | NUMBER OF CYCLES TO FAILURE ($\times 10^4$ CYCLES) | ELONGATION % | IMPACT ABSORBING ENERGY J/cm$^2$ | CONDUCTIVITY % IACS |
|---|---|---|---|---|---|---|
| EXAMPLE | 1 | 3.0 | 85 | 8 | 850 | 52 |
| | 2 | 1.6 | 73 | 7 | 560 | 55 |
| | 3 | 1.5 | 72 | 8 | 670 | 52 |
| | 4 | 1.3 | 79 | 7 | 630 | 55 |
| | 5 | 1.4 | 134 | 9 | 1760 | 52 |
| | 6 | 1.8 | 89 | 13 | 1670 | 49 |
| | 7 | 3.0 | 115 | 12 | 2050 | 50 |
| | 8 | 2.0 | 136 | 9 | 1790 | 52 |
| | 9 | 4.9 | 104 | 13 | 1990 | 48 |
| | 10 | 3.3 | 114 | 12 | 2050 | 49 |
| | 11 | 3.5 | 96 | 11 | 1510 | 49 |
| | 12 | 1.7 | 110 | 13 | 2120 | 48 |
| | 13 | 1.1 | 102 | 14 | 2130 | 47 |
| | 14 | 2.0 | 122 | 11 | 1970 | 50 |
| COMPARATIVE EXAMPLE | 1 | — | ***6*** | ***3*** | ***180*** | 50 |
| | 2 | | WIRE BREAK DURING WIRE DRAWING | | | |
| | 3 | — | ***9*** | ***4*** | ***190*** | 52 |
| | 4 | — | ***4*** | ***4*** | ***170*** | 48 |
| | 5 | | WIRE BREAK DURING WIRE DRAWING | | | |
| | 6 | ***6.2*** | ***4*** | ***3*** | ***160*** | 52 |

N.B.1 NUMERICAL VALUES IN BOLD ITALIC IN THE TABLE ARE OUT OF APPROPRIATE RANGE OF EXAMPLE

TABLE 3

| | | COMPOSITION MASS % | | | | | | | | | | | | | | | | |
|---|---|---|---|---|---|---|---|---|---|---|---|---|---|---|---|---|---|---|
| | No. | Mg | Si | Fe | Cu | Mn | Hf | V | Sc | Co | Ni | Cr | Zr | Au | Ag | Ti | B | Al |
| EXAMPLE | 15 | 0.10 | 0.10 | 0.20 | | 0.20 | | | | | | 0.20 | | | | 0.010 | 0.005 | BAL-ANCE |
| | 16 | 0.30 | 0.30 | 0.20 | 0.20 | | | | | | | | 0.30 | | | 0.010 | 0.005 | |
| | 17 | 0.70 | 0.70 | 0.20 | | | | | | | | | | | | 0.010 | 0.005 | |
| | 18 | 0.50 | 0.50 | 0.20 | 0.10 | 0.10 | | | | | | 0.10 | | | | 0.010 | 0.005 | |
| | 19 | 0.20 | 0.20 | 1.00 | 0.20 | | | | | | | 0.10 | 0.10 | | | 0.010 | 0.005 | |
| | 20 | 0.10 | 0.30 | 0.20 | 0.20 | | | | | | | | | | | 0.010 | 0.005 | |
| | 21 | 0.40 | 0.20 | 0.20 | | 0.20 | | | | | | | | | | | | |
| | 22 | 0.50 | 0.50 | 0.01 | | | | | | 0.05 | | | | | | | | |
| | 23 | 0.60 | 0.10 | 0.20 | | | | | | | | 0.20 | | | | 0.010 | 0.005 | |
| | 24 | 0.10 | 0.50 | 0.20 | | | | | | | | | 0.20 | | | | | |
| | 25 | 0.40 | 0.40 | 1.40 | | | | | | | | | | | | | | |
| | 26 | 0.40 | 0.30 | 0.10 | 0.10 | | | | | | | | | 0.30 | 0.30 | 0.010 | 0.005 | |
| | 27 | 0.10 | 0.50 | 0.10 | 0.20 | 0.10 | | | | | | | 0.10 | | | 0.010 | 0.005 | |
| | 28 | 0.60 | 0.50 | 0.20 | 0.03 | | | | | | | | | | | | | |
| | 29 | 0.50 | 0.60 | 0.20 | | | | | | | 0.05 | | | | | | | |
| | 30 | 0.40 | 0.40 | 0.20 | | | | | | | | | 0.05 | | | | | |
| | 31 | 0.60 | 0.60 | 0.10 | 0.30 | | | | | | | | | | 0.30 | 0.010 | 0.005 | |
| | 32 | 0.70 | 0.80 | 0.10 | 0.10 | | | | | | | | 0.20 | | 0.20 | | | |
| | 33 | 0.50 | 0.60 | 0.20 | | | | | | 0.20 | | | | | | | | |
| | 34 | 0.40 | 0.50 | 0.10 | 0.20 | 0.10 | | | | | | 0.10 | 0.20 | | | 0.010 | 0.005 | |
| | 35 | 1.00 | 1.00 | 0.01 | | | | | 0.40 | 0.20 | 0.40 | | | 0.10 | 0.10 | 0.050 | 0.010 | |
| | 36 | 0.50 | 0.50 | 0.01 | | | | | | | | | | | | | | |
| | 37 | 0.50 | 0.50 | 0.01 | 0.10 | | | | | | | | | 0.20 | 0.20 | | | |
| | 38 | 0.80 | 0.80 | 0.01 | | | 0.40 | 0.40 | | | | 0.20 | | 0.10 | 0.10 | 0.050 | 0.010 | |

TABLE 3-continued

| | No. | COMPOSITION MASS % Mg | Si | Fe | Cu | Mn | Hf | V | Sc | Co | Ni | Cr | Zr | Au | Ag | Ti | B | Al |
|---|---|---|---|---|---|---|---|---|---|---|---|---|---|---|---|---|---|---|
| | 39 | 0.50 | 0.50 | 0.01 | | | | | 0.10 | | | | | | | | | |
| | 40 | 0.60 | 0.60 | 0.01 | | | 0.40 | | | | 0.40 | 0.20 | | 0.10 | 0.10 | 0.050 | 0.010 | |
| COMPARA- | 7 | ***0.01*** | ***0.01*** | 0.20 | 0.01 | 0.01 | | | | | | | | | | | | |
| TIVE | 8 | ***1.20*** | 1.00 | 0.20 | | | | | | | | | 0.07 | | | | | |
| EXAMPLE | 9 | ***3.00*** | 0.80 | 0.20 | | | | | | | | | | | | | | |
| | 10 | 0.50 | ***2.00*** | 0.20 | | | | | | | | | | | | | | |
| | 11 | 0.50 | 0.50 | | ***2.00*** | | | | | | | | ***2.00*** | | | | | |
| | 12 | 0.52 | 0.67 | 0.13 | | | | | | | | 0.20 | | | | 0.020 | 0.004 | |

N.B.1 NUMERICAL VALUES IN BOLD ITALIC IN THE TABLE ARE OUT OF APPROPRIATE RANGE OF THE EXAMPLE

TABLE 4

| | No. | CASTING COOLING RATE ° C./sec | DRAWING PROCESS REDUCTION RATIO PER PASS % | DIE HALF ANGLE DEGREE | INTERMEDIATE ANNEALING ENERGY AREA ° C. · h | AGING TEMP. ° C. | AGING TIME h | DIPERSION DENSITY DETERMINATION |
|---|---|---|---|---|---|---|---|---|
| EXAMPLE | 15 | 10 | 28 | 7 | 1800 | 175 | 5 | ACCEPTABLE |
| | 16 | 10 | 28 | 7 | 1800 | 175 | 5 | ACCEPTABLE |
| | 17 | 10 | 28 | 7 | 1800 | 175 | 5 | ACCEPTABLE |
| | 18 | 10 | 28 | 7 | 1800 | 175 | 5 | ACCEPTABLE |
| | 19 | 10 | 28 | 7 | 1800 | 175 | 5 | ACCEPTABLE |
| | 20 | 10 | 28 | 7 | 1800 | 175 | 5 | ACCEPTABLE |
| | 21 | 20 | 40 | 1 | 2400 | 140 | 5 | ACCEPTABLE |
| | 22 | 5 | 36 | 2 | 2400 | 250 | 0.5 | ACCEPTABLE |
| | 23 | 20 | 40 | 1 | 2400 | 140 | 5 | ACCEPTABLE |
| | 24 | 20 | 40 | 1 | 2400 | 140 | 5 | ACCEPTABLE |
| | 25 | 20 | 40 | 1 | 2400 | 140 | 5 | ACCEPTABLE |
| | 26 | 20 | 40 | 1 | 2400 | 140 | 5 | ACCEPTABLE |
| | 27 | 20 | 40 | 1 | 2400 | 140 | 5 | ACCEPTABLE |
| | 28 | 20 | 35 | 4 | 600 | 150 | 10 | ACCEPTABLE |
| | 29 | 20 | 35 | 4 | 600 | 150 | 10 | ACCEPTABLE |
| | 30 | 20 | 35 | 4 | 600 | 150 | 10 | ACCEPTABLE |
| | 31 | 5 | 36 | 2 | 2400 | 250 | 0.5 | ACCEPTABLE |
| | 32 | 5 | 36 | 2 | 2400 | 250 | 0.5 | ACCEPTABLE |
| | 33 | 20 | 35 | 4 | 600 | 150 | 10 | ACCEPTABLE |
| | 34 | 5 | 36 | 2 | 2400 | 250 | 0.5 | ACCEPTABLE |
| | 35 | 5 | 36 | 2 | 2400 | 250 | 0.5 | ACCEPTABLE |
| | 36 | 5 | 36 | 2 | 2400 | 250 | 0.5 | ACCEPTABLE |
| | 37 | 5 | 36 | 2 | 2400 | 250 | 0.5 | ACCEPTABLE |
| | 38 | 20 | 35 | 4 | 600 | 150 | 10 | ACCEPTABLE |
| | 39 | 20 | 35 | 4 | 600 | 150 | 10 | ACCEPTABLE |
| | 40 | 20 | 35 | 4 | 600 | 150 | 10 | ACCEPTABLE |
| COMPARATIVE | 7 | 10 | 10 | 6 | 1800 | 150 | 5 | ACCEPTABLE |
| EXAMPLE | 8 | 3 | 10 | 7 | ***-850*** | 180 | 20 | NOT ACCEPTABLE |
| | 9 | 10 | 20 | ***20*** | 600 | 200 | 15 | ACCEPTABLE |
| | 10 | 15 | 20 | 10 | 1200 | 175 | 10 | ACCEPTABLE |
| | 11 | 10 | 10 | 8 | WIRE BREAK DURING DRAWING | | | |
| | 12 | ***0.01*** | 20 | 10 | 400 | 250 | 8 | ACCEPTABLE |

| | No. | GRAIN DISTRIBUTION MAX/MIN FACTOR | NUMBER OF CYCLES TO FAILURE ($\times 10^4$ CYCLES) | ELONGATION % | IMPACT ABSORBING ENERGY J/cm$^2$ | CONDUCTIVITY % IACS |
|---|---|---|---|---|---|---|
| EXAMPLE | 15 | 3.3 | 10 | 15 | 210 | 54 |
| | 16 | 2.6 | 46 | 10 | 870 | 53 |
| | 17 | 3.0 | 149 | 5 | 1840 | 49 |
| | 18 | 3.0 | 110 | 8 | 1750 | 48 |
| | 19 | 3.1 | 20 | 13 | 440 | 52 |
| | 20 | 3.2 | 15 | 14 | 220 | 53 |
| | 21 | 1.3 | 18 | 17 | 530 | 50 |
| | 22 | 1.5 | 69 | 8 | 1110 | 55 |
| | 23 | 1.1 | 13 | 17 | 360 | 46 |
| | 24 | 1.3 | 12 | 18 | 350 | 47 |
| | 25 | 1.1 | 42 | 13 | 1050 | 51 |
| | 26 | 1.2 | 39 | 14 | 1060 | 48 |
| | 27 | 1.0 | 12 | 18 | 350 | 47 |

TABLE 4-continued

| | | | | | | |
|---|---|---|---|---|---|---|
| | 28 | 2.0 | 104 | 11 | 2340 | 54 |
| | 29 | 1.9 | 112 | 10 | 2290 | 54 |
| | 30 | 2.0 | 56 | 13 | 1440 | 56 |
| | 31 | 1.5 | 90 | 5 | 840 | 52 |
| | 32 | 1.4 | 114 | 6 | 1360 | 48 |
| | 33 | 1.9 | 120 | 10 | 2320 | 51 |
| | 34 | 1.7 | 60 | 5 | 530 | 49 |
| | 35 | 1.5 | 132 | 5 | 1310 | 42 |
| | 36 | 1.5 | 66 | 8 | 1010 | 56 |
| | 37 | 1.5 | 68 | 9 | 1190 | 54 |
| | 38 | 2.1 | 141 | 8 | 2510 | 46 |
| | 39 | 2.0 | 88 | 12 | 2150 | 53 |
| | 40 | 1.8 | 120 | 10 | 2460 | 44 |
| COMPARATIVE | 7 | ***8.0*** | ***4*** | 23 | 350 | 62 |
| EXAMPLE | 8 | — | ***9*** | ***12*** | ***180*** | 48 |
| | 9 | ***9.0*** | ***2*** | 3 | ***120*** | 34 |
| | 10 | ***10.0*** | ***3*** | ***1*** | 200 | 38 |
| | 11 | WIRE BREAK DURING DRAWING | | | | |
| | 12 | — | ***8*** | 4 | ***170*** | 52 |

N.B.1 NUMERICAL VALUES IN BOLD ITALIC IN THE TABLE ARE OUT OF APPROPRIATE RANGE OF EXAMPLE

The following is elucidated from the results indicated in Table 2.

Each of aluminum alloy wires of Examples 1 to 14 showed a high conductivity, a high bending fatigue resistance, a high impact absorption property and a high elongation.

In contrast, in Comparative Examples 1 and 4, an energy area during intermediate annealing and a particle size were beyond the scope of the present disclosure, and the number of cycles to fracture, an elongation and an impact absorption energy were insufficient. In Comparative Examples 2 and 5, there was a wire break during wire drawing. In Comparative Example 3, a casting cooling temperature and a particle size were beyond the scope of the present disclosure, and the number of cycles to fracture, an elongation and an impact absorption energy were insufficient. In Comparative Example 6, a reduction ratio per pass, a die half angle and a particle distribution were beyond the scope of the present disclosure and the number of cycles to fracture, an elongation and an impact absorption energy were insufficient.

Also, the following is elucidated from the results indicated in Table 4.

Each of aluminum alloy wires of Examples 15 to 40 showed a high conductivity, a high bending fatigue resistance, a high impact absorption property and a high elongation.

In contrast, in Comparative Example 7, an Mg content, an Si content and a particle distribution were beyond the scope of the present disclosure, and, the number of cycles to fracture was insufficient. In Comparative Example 8, an Mg-content, a casting cooling rate and an energy area during intermediate annealing and a particle size were beyond the scope of the present disclosure, and, the number of cycles to fracture, an elongation and an impact absorption energy were insufficient. In Comparative Example 9, an Mg-content, a die half angle and a particle distribution were beyond the scope of the present disclosure, and the number of cycles to fracture, an elongation, an impact absorption energy and a conductivity were insufficient. In Comparative Example 10, an Si-content and a particle distribution were beyond the scope of the present disclosure, and the number of cycles to fracture, an elongation and a conductivity were insufficient. In Comparative Example 11, a Cu-content, a Zr-content and a particle distribution were beyond the scope of the present disclosure, and a wire break occurred during wire drawing. Further, in Comparative Example 12, a casting cooling rate and a particle size were beyond the scope of the present disclosure, and the number of cycles to fracture, an elongation and an impact absorption energy were insufficient.

The aluminum alloy conductor of the present disclosure may be composed of an Al—Mg—Si-based alloy, e.g., 6xxx series aluminum alloy, and, even when used as an extra fine wire having a diameter of ϕ0.5 mm or smaller, it can be used as a wire rod for an electric wiring structure that shows a high conductivity, a high bending fatigue resistance, and a high elongation. Also, it can be used for an aluminum alloy stranded wire, a coated wire, a wire harness, and the like, and it is useful as a battery cable, a harness or a lead wire for motor that are installed in transportation vehicles, and an electric wiring structure for industrial robots. Further, it can be preferably used in doors, a trunk, and an engine hood that require a very high bending fatigue resistance.

What is claimed is:

1. An aluminum alloy wire rod having a composition consisting of Mg: 0.30 mass % to 0.70 mass %, Si: 0.30 mass % to 0.70 mass %, Fe: 0.01 mass % to 1.40 mass %, Ti: 0.000 mass % to 0.100 mass %, B: 0.000 mass % to 0.030 mass %, Ag: 0.00 mass % to 0.50 mass %, Au: 0.00 mass % to 0.50 mass %, Mn: 0.00 mass % to 1.00 mass %, Cr: 0.00 mass % to 1.00 mass %, Zr: 0.00 mass % to 0.50 mass %, Hf: 0.00 mass % to 0.50 mass %, V: 0.00 mass % to 0.50 mass %, Sc: 0.00 mass % to 0.50 mass %, Co: 0.00 mass % to 0.50 mass %, Ni: 0.00 mass % to 0.50mass %, and the balance: Al and incidental impurities, wherein a dispersion density of compound particles having a particle size of 20 nm to 1000 nm is greater than or equal to 1 particle/$\mu m^2$ and in a distribution of the compound particles in the aluminum alloy wire rod, a maximum dispersion density of the compound particles is less than or equal to five times a minimum dispersion density of the compound particles.

2. The aluminum alloy wire rod according to claim 1, wherein the composition consists of at least one element selected from a group consisting of Ti: 0.001 mass % to 0.100 mass % and B: 0.001 mass % to 0.030 mass %.

3. The aluminum alloy wire rod according to claim 1, wherein the composition consists of at least one element selected from a group consisting of Ag: 0.01 mass % to 0.50 mass %, Au: 0.01 mass % to 0.50 mass %, Mn: 0.01 mass % to 1.00 mass %, Cr: 0.01 mass % to 1.00 mass %, Zr: 0.01 mass % to 0.50 mass %, Hf: 0.01 mass % to 0.50 mass %, V: 0.01 mass % to 0.50 mass %, Sc: 0.01 mass % to 0.50 mass %, Co: 0.01 mass % to 0.50 mass %, and Ni: 0.01 mass % to 0.50 mass %.

4. The aluminum alloy wire rod according to claim 1, wherein a sum of contents of Fe, Ti, B, Ag, Au, Mn, Cr, Zr, Hf, V, Sc, Co, and Ni is 0.01 mass % to 2.00 mass %.

5. The aluminum alloy wire rod according to claim 1, wherein number of cycles to fracture measured in a bending fatigue test is greater than or equal to 100,000 cycles, a conductivity is 45% to 60% IACS and an elongation is 5% to 20%.

6. The aluminum alloy wire rod according to claim 1 wherein an impact absorption energy is greater than or equal to 200 J/cm$^2$.

7. The aluminum alloy wire rod according to claim 1, wherein the aluminum alloy wire rod has a diameter of 0.1 mm to 0.5 mm.

8. An aluminum alloy stranded wire comprising a plurality of aluminum alloy wire rods as claimed in claim 1 which are stranded together.

9. A coated wire comprising a coating layer at an outer periphery of the aluminum alloy stranded wire as claimed in claim 8.

10. A wire harness comprising the coated wire as claimed in claim 9 and a terminal fitted at an end portion of the coated wire, the coating layer being removed from the end portion.

11. An aluminum alloy wire rod having a composition consisting of Mg: 0.50 mass % to 1.00 mass %, Si: 0.50 mass % to 1.00 mass %, Fe: 0.01 mass % to 1.40 mass %, Ti: 0.000 mass % to 0.100 mass %, B: 0.000 mass % to 0.030 mass %, Ag: 0.00 mass % to 0.50 mass %, Au: 0.00 mass % to 0.50 mass %, Mn: 0.00 mass % to 1.00 mass %, Cr: 0.00 mass % to 1.00 mass %, Zr: 0.00 mass % to 0.50 mass %, Hf: 0.00 mass % to 0.50 mass %, V: 0.00 mass % to 0.50 mass %, Sc: 0.00 mass % to 0.50 mass %, Co: 0.00 mass % to 0.50 mass %, Ni: 0.00mass % to 0.50 mass %, and the balance: Al and incidental impurities, wherein a dispersion density of compound particles having a particle size of 20 nm to 1000 nm is greater than or equal to 1 particle/μm$^2$ and in a distribution of the compound particles in the aluminum alloy wire rod, a maximum dispersion density of the compound particles is less than or equal to five times a minimum dispersion density of the compound particles.

12. The aluminum alloy wire rod according to claim 11, wherein the composition consists of at least one element selected from a group consisting of Ti: 0.001 mass % to 0.100 mass % and B: 0.001 mass % to 0.030 mass %.

13. The aluminum alloy wire rod according to claim 11, wherein the composition consists of at least one element selected from a group consisting of Ag: 0.01 mass % to 0.50 mass %, Au: 0.01 mass % to 0.50 mass %, Mn: 0.01 mass % to 1.00 mass %, Cr: 0.01 mass % to 1.00 mass %, Zr: 0.01 mass % to 0.50 mass %, Hf: 0.01 mass % to 0.50 mass %, V: 0.01 mass % to 0.50 mass %, Sc: 0.01 mass % to 0.50 mass %, Co: 0.01 mass % to 0.50 mass %, and Ni: 0.01 mass % to 0.50 mass %.

14. The aluminum alloy wire rod according to claim 11, wherein a sum of contents of Fe, Ti, B, Ag, Au, Mn, Cr, Zr, Hf, V, Sc, Co, and Ni is 0.01 mass % to 2.00 mass %.

15. The aluminum alloy wire rod according to claim 11, wherein number of cycles to fracture measured in a bending fatigue test is greater than or equal to 100,000 cycles, a conductivity is 45% to 60% IACS and an elongation is 5% to 20%.

16. The aluminum alloy wire rod according to claim 11, wherein the aluminum alloy wire rod has a diameter of 0.1 mm to 0.5 mm.

17. An aluminum alloy stranded wire comprising a plurality of aluminum alloy wire rods as claimed in claim 11 which are stranded together.

18. A coated wire comprising a coating layer at an outer periphery of the aluminum alloy stranded wire as claimed in claim 17.

19. A wire harness comprising the coated wire as claimed in claim 18 and a terminal fitted at an end portion of the coated wire, the coating layer being removed from the end portion.

20. A method of manufacturing an aluminum alloy wire rod as claimed in claim 1, the aluminum alloy wire rod being obtained by carrying out a dissolving process, a casting process, a hot or cold working process, a first wire drawing process, an intermediate heat treatment, a second wire drawing process, a solution heat treatment and an aging heat treatment in this order, wherein, a cooling rate of the casting process is 5° C./s to 20° C./s, the intermediate heat treatment is performed in a temperature range of 300° C. to 480° C., an energy area of an energy applied to an aluminum alloy conductor rod in the temperature range is 180° C.·h to 2500° C.·h, a die used in the first wire drawing process has a die half angle of 1° to 10° and a reduction ratio per pass of 10% to 40%, and a die used in the second wire drawing process has a die half angle of 1° to 10° and a reduction ratio per pass of 10% to 40%.

* * * * *